US006584297B2

(12) United States Patent
Fuma et al.

(10) Patent No.: US 6,584,297 B2
(45) Date of Patent: Jun. 24, 2003

(54) IMAGE FIXING DEVICE AND IMAGE FORMING APPARATUS EQUIPPED THEREWITH

(75) Inventors: Hiroshi Fuma, Hachioji (JP); Hisayoshi Nagase, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/078,998

(22) Filed: Feb. 19, 2002

(65) Prior Publication Data

US 2002/0118983 A1 Aug. 29, 2002

(30) Foreign Application Priority Data

Feb. 27, 2001 (JP) ..... 2001-052031

(51) Int. Cl.[7] ..... G03G 15/20
(52) U.S. Cl. ..... 399/329; 399/68
(58) Field of Search ..... 399/67, 68, 320, 399/328, 329, 330; 219/216

(56) References Cited

U.S. PATENT DOCUMENTS 5,873,020 A * 2/1999 Matsuura et al. ..... 399/329
5,999,764 A * 12/1999 Okabayashi et al. ..... 399/67

* cited by examiner

*Primary Examiner*—Hoang Ngo
(74) *Attorney, Agent, or Firm*—Muserlian, Lucas and Mercanti

(57) ABSTRACT

An image fixing apparatus in which a fixing belt is trained about a plurality of support rollers including therein one support roller housing a heat applying source, and a relative position of a pair of pressure rollers is changed, which are oppositely arranged with the fixing belt interposed between them, to a pressure position, a traveling path of the fixing belt is changed, and through the fixing belt whose path is changed, the heat applying source and the support roller housing the heat applying source are integrally movable.

7 Claims, 5 Drawing Sheets

IMAGE FIXING DEVICE AND IMAGE FORMING APPARATUS EQUIPPED THEREWITH

BACKGROUND OF THE INVENTION

The present invention relates to an image fixing device whose main component is a fixing belt, and to an image forming apparatus such as a copier and a printer structured so that a variation of a path of the fixing belt in the image fixing device is controlled following a fixing processing motion.

An image forming apparatus having the image fixing device (hereinafter, simply called the fixing device) structured in such a manner that a sheet on which a toner image is carried, is fed between the fixing belt which is supported by a plurality of rotatable support rollers and heated by an appropriate heat applying source, and a pressure roller provided so that it is rotated while being pressure-contacted with the fixing belt, and the pressing and heating actions are given to it, and the toner image is fixed onto the sheet, is well known.

As one embodiment of the fixing device as described above, there is considered a structure by which, for example, two pressure rollers are oppositely arranged to each other with the fixing belt between them, and in the advancing direction of the fixing belt, an axial center is slightly shifted, and at the time of the fixing processing, a relative position of both pressure rollers is changed, and the fixing belt is forcibly bent and supported, and to the sheet passing between the fixing belt and the pressure roller, its contact area contributing to the fixing is increased.

Although such the enlargement of the fixing nip width makes the thermal efficiency enhance, and the stable fixing processing possible, according to circumstances, in order to obtain the necessary length for the curvature formation of the fixing belt at the time of the fixing, there is a case in which it is necessary that a position of any support roller is moved.

At that case, it is also considered that the support roller whose position is moved, is a structure in which it includes internally (hereinafter, also called internally contained) the heat applying source.

SUMMARY OF THE INVENTION

The object of the present invention is to provide an image fixing device structured in such a manner that the heat applying source is housed in one of support rollers around which the fixing belt is trained as described above, and accompanied by the forcible variation (the same meaning as the above-described forcible curvature formation) of the traveling path of the fixing belt, the position of the support roller in which the heat applying source is housed, can be safely moved, and to provide an image forming apparatus which can control so that a wide nip portion is structured accompanied by the fixing processing, and the enhancement of the thermal efficiency can be attained.

The purpose of the present invention can be attained by the following structures.

(1) An image fixing apparatus which is characterized in that, by training a fixing belt around a plurality of support rollers including one support roller housing a heat applying source, and by changing a relative position of a pair of pressure rollers which are oppositely arranged with the fixing belt interposed between them, to a pressure position, a traveling path of the fixing belt is changed, and through the fixing belt whose path is changed, the heat applying source and the support roller housing the heat applying source are structured to be integrally movable.

(2) An image fixing apparatus which is characterized by having: a fixing belt trained around a plurality of support rollers including a rotatable support roller housing the heat applying source; a pressure roller which is selectively positioned at a pressure position to which a traveling path of the fixing belt is changed, by pressing the fixing belt; and a support member whose drive source is the fixing belt whose traveling path is varied, and by which the heat applying source, the support roller housing the heat applying source and at least one portion of a casing to shield the support roller from the periphery thereof, are supported so as to be integrally movable.

(3) An image forming apparatus which is characterized in that it has the image fixing apparatus described in above structure (1) or (2), and has a control means for controlling a movement to a pressure position of the pressure roller onto the fixing belt and a pressure release, accompanied by a fixing processing operation.

DETAILED DESCRIPTION OF THE PREFERRED EMBODIMENT

Figure 1:
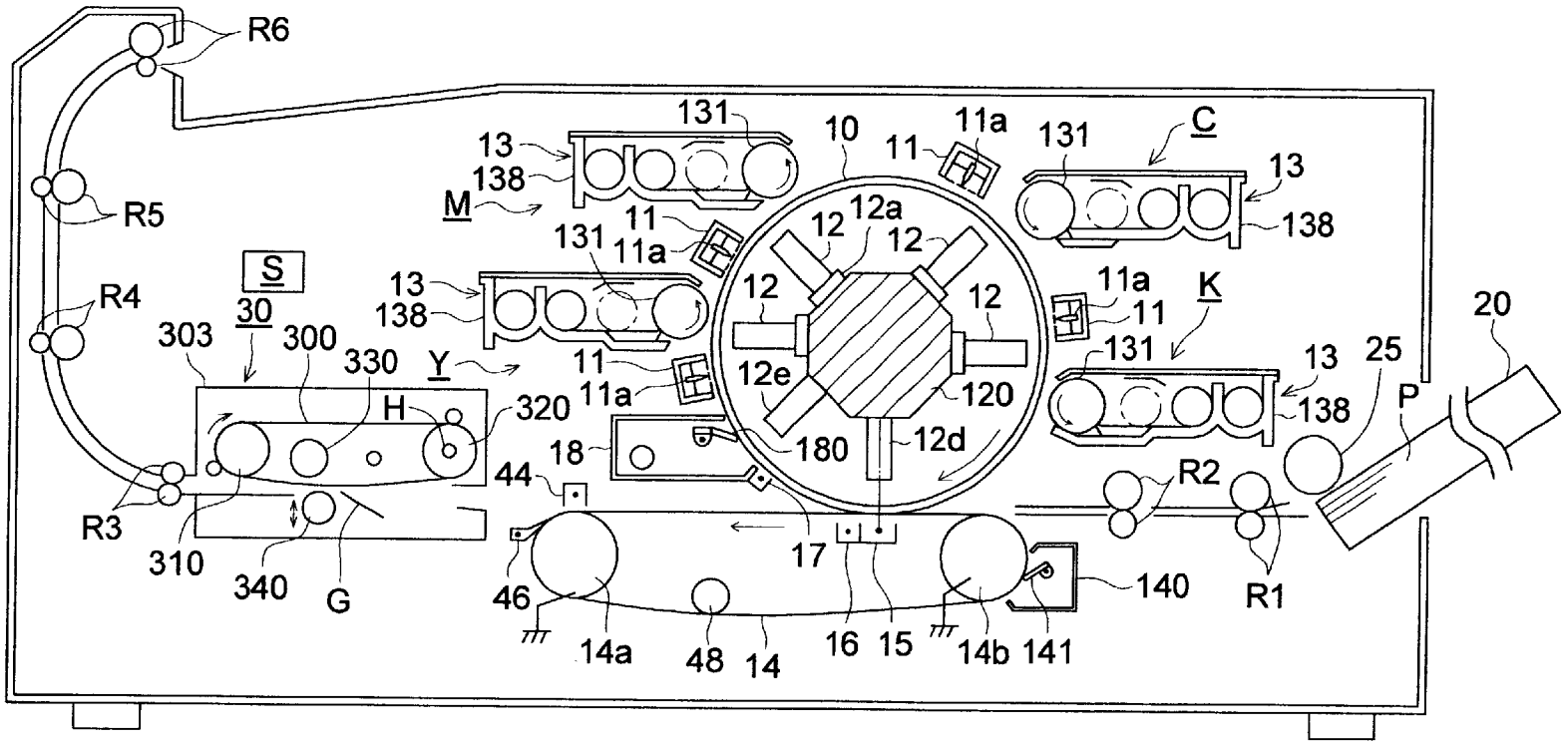
FIG. 1 is an outline view showing the first embodiment of an image forming apparatus composed of a color printer according to the present invention.

Referring to the drawings, embodiments according to the present invention will be described below.

Figure 2:
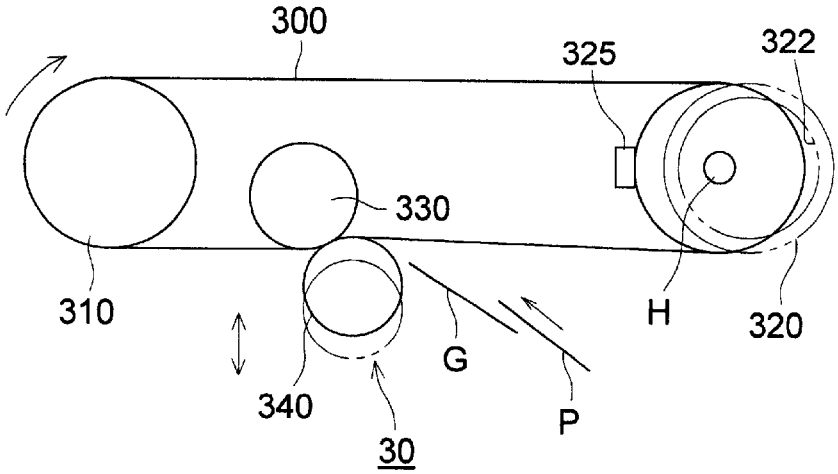
FIG. 2 is a typical view showing partially enlargedly a positional relationship of a fixing belt and a pressure roller at the fixing processing time.

FIG. 1 is an outline view showing the first embodiment of an image forming apparatus composed of a color printer according to the present invention, and FIG. 2 is a typical view showing partially enlargedly a positional relationship of a fixing belt and a pressure roller at the fixing processing time.

In the drawing, numeral 10 is a photoreceptor drum (hereinafter, simply called drum) which is an image forming body, numeral 11 is a scorotron charger which is a charging means for each color, numeral 12 is an exposure optical system which is an image writing means for each color, numeral 13 is a developing device which is a developing means for each color, and numeral 14 is a transfer belt.

The drum 10 is, for example, a drum in which, on the outer periphery of a cylindrical base body formed of a transparent member such as the optical glass or transparent acrylic resin, a photoreceptor layer such as a transparent conductive layer, a-Si layer or organic photoreceptor layer (OPC) is formed, and in the condition that the conductive layer is electrically grounded, it is rotated in the clockwise direction shown by an arrow in FIG. 1.

The scorotron charger 11, exposing optical system 12 and developing device 13 are made one set, and as a means for an image process (hereinafter, there is a case called image forming means) of a yellow (Y), magenta (M), cyan (C), and black (K), 4 sets are provided, and in the rotational direction of the drum 10, they are arranged in the order of Y, M, C, K.

Because the mechanical structure of 4 set image forming means is basically the same, hereinafter, their details will be expiated with the explanation of the structure of one set.

The scorotron charger 11 has a control grid and a discharge electrode 11*a*, which are respectively maintained at a predetermined potential, and is attached opposite to the photoreceptor layer of the drum 10, and by a corona discharge whose polarity is same as a toner, a uniform potential is given on the surface of the drum 10.

The exposing optical system 12 is arranged inside the drum 10 so that it is positioned on the rotational direction downstream side of the drum 10 to the scorotron charger 11.

The exposing optical system 12 is an exposure unit composed of a linear exposure element 12*a* in which a plurality of LEDs (light emitting diode) as light emitting elements of an image exposure light which are aligned in the primary scanning direction in parallel with a drum axis, are aligned array-like, light converging light transmitting body (trade name: Selfoc lens array) as an image forming element, and lens holder, not shown, and it is attached to a holding member 120.

On the holding member 120, other than the exposing optical system for each color 12, a transfer simultaneous exposure device 12*d* and uniform exposure device 12*e* which are composed of the same structure, are attached, and they are integrally housed inside the base body of the drum 10.

The exposing optical system 12 is read by a separately provided image reading device, and according to the image data stored in a memory, it image-exposes the photoreceptor layer of the drum 10 from the rear surface, and forms an electrostatic latent image on the drum 10.

The developing device 13 has a developing sleeve 131 formed of a cylindrical non-magnetic stainless steel or aluminum material in which a predetermined gap is kept to the peripheral surface of the drum 10, and which is rotated in the normal direction viewed at the proximate point to the rotational direction of the drum 10, and a developing casing 138, and inside the developing casing 138, each of one component or two component developers of yellow(Y), magenta(M), cyan(C), and black(K), is respectively accommodated.

The developing device 13 is kept non-contact in such a manner that a predetermined gap is provided to the drum 10, and when a developing bias voltage in which a DC voltage and an AC voltage are superimposed, is applied onto the developing sleeve 131, it conducts a non-contact reversal development, and a toner image is formed on the drum 10.

Numerals 14*a* and 14*b* are rollers around which the transfer belt 14 is trained, and it is structured in such a manner that 14*a* receives a motive power from a drive source, not shown, and the transfer belt 14 is rotated in the arrowed direction.

Numerals 15 and 16 are a transfer device and a discharger which are arranged oppositely to the drum 10 with the transfer belt 14 between them, numeral 17 is an AC discharger to discharge the drum 10 after the transfer area passage, and numeral 18 is a cleaning device to clean the surface of the drum after the discharge, and has a cleaning blade 180.

Numeral 20 is a cassette in which a sheet P onto which the toner image formed on the drum 10 is transferred, is accommodated, and numeral 25 is a sheet feed roller.

On the traveling path of the sheet P, conveying roller pairs R1 to R6, and a fixing device 30 including a fixing belt 300 which is driven at the same line speed as the traveling speed of the transfer belt 14 and sheet P, are provided.

Numeral 44 shows an AC discharger for the sheet separation arranged oppositely to the roller 14*a* through the transfer belt 14.

The fixing device 30 is structured by: a casing (hereinafter, called outer frame) forming a sealing condition except a gateway of the sheet P; the endless fixing belt 300 formed by molding the metallic base body and silicon rubber into belt-like; a rotatable second support roller 320 including a rotatable first support roller 310 (in the present embodiment, when the first support roller is connected to a drive system provided on the image forming apparatus main body side, it functions as a drive roller of the fixing belt 300) to support the fixing belt rotatably, and the heat applying source H; a pressure means 330 (for the convenience of explanation, hereinafter, called the first pressure roller) composed of a rotatable and a position-fixed rollers which is inside a loop formed by the fixing belt 300, and provided in close vicinity to the first support roller 310; and a pressure means 340 (for the convenience of explanation, hereinafter, called the second pressure roller) composed of a rotatable roller which is outside the fixing belt 300, and provided oppositely to the first pressure roller 330.

The first pressure roller 330 and the second pressure roller 340 are separated from the fixing belt 300 at the non-fixing processing time, (the second pressure roller is at the pressure release position shown by a dotted line in FIG. 2), and they are controlled through a control means S so that, at the fixing processing time, when the second pressure 340 is selectively positioned at a predetermined pressure position (solid line position in FIG. 2), the condition that they hold the fixing belt, is made, and when the fixing processing is completed, they return to the pressure release position (home position).

In other words, at the fixing processing time, specifically, the relative position movement of both pressure rollers prior to the fixing processing varies the traveling path of the fixing belt 300 and forcibly forms the curvature portion, and secures a wide contact area with the fixing belt 300, however, for that purpose, in the advance direction of the fixing belt, the axial center of both pressure rollers is provided by being slightly shifted.

The second support roller 320 is structured in such a manner that, when the path of the fixing belt 300 is changed, (in FIG. 2, pulled to the left side), the second support roller 320 is parallely moved from the initial position shown by a dotted line to a solid line position by using the force at the time of the movement of the fixing belt 300 as a drive source.

In this case, although it is also possible to be structured in such a manner that, when its moving amount is small, only the second support roller 320 is moved by pulling, in the present embodiment, as will be described later, in order to eliminate the possibility of interference of an internal surface wall 322 of the second support roller 320 with the heat applying source H, the present embodiment is structured in such a manner that the second support roller 320 and the heat applying source H (in practice, with also a temperature detection sensor 325) can be integrally moved.

In this connection, thee drawing of the movement mechanism of the second pressure roller 340 is neglected because the movement of the second pressure roller 340 can be simply performed by the conventional technology such as the use of a plunger.

The first pressure roller 330 in the present embodiment has a structure in which rubber or sponge is covered over a core metal, and the second pressure roller 340 has a silicon rubber layer on the surface.

Further, the fixing belt at the non-fixing processing time is not in a strained condition, and is trained about the first support roller 310 and the second support roller 320 with a slight slack.

For example, the fixing belt 300 is trained between the first support roller 310 and the second support roller 320 with a very weak tension not larger than 500 N/m, more preferably not larger than 200 N/m, and a condition that the fixing belt has a slack of the tension 0, may also be allowed.

Returning to FIG. 1, G is a guide plate, and numeral 46 is a separation claw and its leading edge is positioned in close vicinity to the surface of the transfer belt 14 on the roller 14*a*.

Various controls in the present embodiment are conducted through a control means S composed of a computer.

For example, by the turning on of a main switch provided in the image forming apparatus, the fixing belt 300 and the first pressure roller 330 are rotated, and the electric power is supplied to the heat applying source H.

Further, the control means S conducts the electric power control (electric power supply control) onto the heat applying source H on the base of the output information of a temperature detection sensor 325 provided at an almost central portion in the longitudinal direction of the second support roller 320.

Further, when an image formation command is inputted, each kind of control based on the taking-in information such as the selected sheet size, image density, or image magnification, is conducted.

The image forming process in the image forming apparatus having the above-described structure is as follows.

After the fixing device 30 is in the fixing processing possible condition (warm-up completion), when a drum drive motor, not shown, is started by the start of the image forming process, the drum 10 is rotated clockwise as shown by an arrow in FIG. 1, and simultaneously, the yellow (Y) scorotron charger 11 is operated, and the predetermined potential is given to the drum 10.

Succeedingly, the image writing according to an electric signal corresponding to the first color signal, that is, Y image data, is started through the Y exposure optical system 12, and an electrostatic latent image corresponding to a Y image of a document image is formed on the surface of the drum 10.

The electrostatic latent image is reversal developed in the condition of non-contact by a Y developing device 13, and a yellow (Y) toner image is formed on the drum 10.

Next, the drum 10 is given the potential by the charging action of a magenta (M) scorotron charger 11 onto the Y toner image, and the electrostatic latent image corresponding to a M image is formed by the image writing by the electric signal corresponding to the second color signal, that is, the M image data by the M exposure optical system 12, and the magenta (M) toner image is formed by being superimposed on the yellow (Y) toner image by the non-contact reversal development by the M developing device 13.

By the same process, by a cyan (C) scorotron charger 11, C exposure optical system 12, and C developing device 13, the cyan (C) toner image corresponding to the third color signal is formed by being superimposed, and further thereon, by a black (K) scorotron charger 11, K exposure optical system 12 and K developing device 13, the black (K) toner image corresponding to the fourth color signal is successively superimposed and formed, and within one rotation of the photoreceptor drum 10, the four color superimposed color toner images of yellow (Y), magenta (M), cyan (C) and black (K) are formed on its peripheral surface, and after that, in the transfer area, by the action of the transfer device 15, they are collectively transferred onto the sheet P conveyed in timed relationship with the photoreceptor drum 10.

In this case, it is preferable that the transfer simultaneous exposure device 12*d* provided inside the drum 10 is excited and the uniform exposure is conducted so that the good transferring is performed.

After the toner remained on the peripheral surface of the drum 10 after the completion of the transferring process, is subjected to the discharging action by the AC discharger 17, it is cleaned by the cleaning device 18, thereby, the drum surface is ready for the next image formation.

In the embodiment, after cleaning, and before the next charging, a uniform exposure device 12*e* using, for example, the light emitting diode is operated, and the hysteresis in the preceding image formation of the drum surface is eliminated.

On the one hand, after the sheet P onto which the color toner image is transferred, is separated from the drum 10 by the action of the discharger 16, it is conveyed by the transfer belt 14, and is separated from the transfer belt 14 by the discharging action by the AC discharger 44 and separation claw 46, and next, it is guided to the fixing device 30.

Before the fixing processing, the surface of the fixing belt 300 is maintained at the predetermined temperature to fix the toner image, and the second pressure roller 340 is elevated, and the traveling path formed at the non-fixing processing time of the fixing belt 300 is changed.

Accordingly, in the wide contact area formed by the fixing belt 300 and the first and second pressure rollers 330 and 340, the toner images and the sheet P are subjected to the pressure and heating actions, and the toner images are successively fixed onto the sheet P.

After that, the sheet P is separated by the curvature of the first pressure roller 330, and after being conveyed by the conveying roller pairs R3 to R6, it is discharged to the outside of the apparatus.

After the fixing processing to the sheet P is completed, the pressure condition of the first pressure roller 330 and the second pressure roller 340 is released, and following that, the wrinkle or twist of the fixing belt 300 generated at the pressure contact time, or the elongation and shrinkage due to the difference of the speed, are eliminated.

Figure 3:
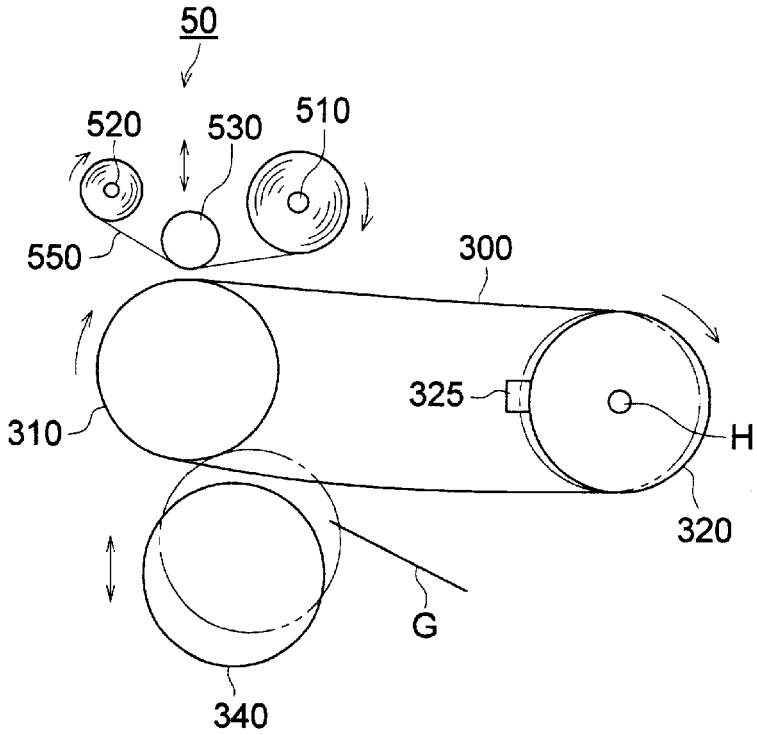
FIG. 3 is a view enlargedly showing only a main portion of the second embodiment as the fixing device in the image forming apparatus in FIG. 1.

FIG. 3 is a view showing the second embodiment as the fixing device in the image forming apparatus in FIG. 1, and the view is shown by enlarging only the main portion.

In the view, relating to members (means) exhibiting the same structure or function as the above-described members (means), the same reference numerals are denoted, and for omitting the doubling of the explanation, mainly, only the different structural portion will be described below.

In this connection, a dotted line in the view shows the pressure position of the second pressure roller 340 and the position after the movement of the second support roller 320 at the fixing processing time.

The different structure from the above-described fixing device is that the function of the first pressure roller which is the element by which the traveling path of the fixing belt 300 is changed and the fixing belt is nipped in the curvature condition, is combinedly provided to the first support roller 310.

In this connection, numeral 50 is a web device having the function by which the oil is coated on the fixing belt 300, and simultaneously the cleaning function, and a web supply reel 510, web winding reel 520 and web pressure roller 530 are main elements.

The web pressure roller 530 is controlled in such a manner that it is lowered at the fixing processing time, and the web 550 is lightly pressure-contacted with the fixing belt 300 on the first support roller 510, and after the fixing processing completion, the web pressure roller 530 is elevated, and the light pressure-contact is released.

The movement mechanism of the web pressure roller 530 can utilize the publicly known technology, for example, the above-described plunger.

In also the present embodiment, when the traveling path of the fixing belt is changed, by utilizing the force at the movement time of the fixing belt, the above-described heat applying source H and the second support roller 320 including internally the heat applying source (in practice, also the temperature detection sensor 325) are integrally moved.

Figure 4:
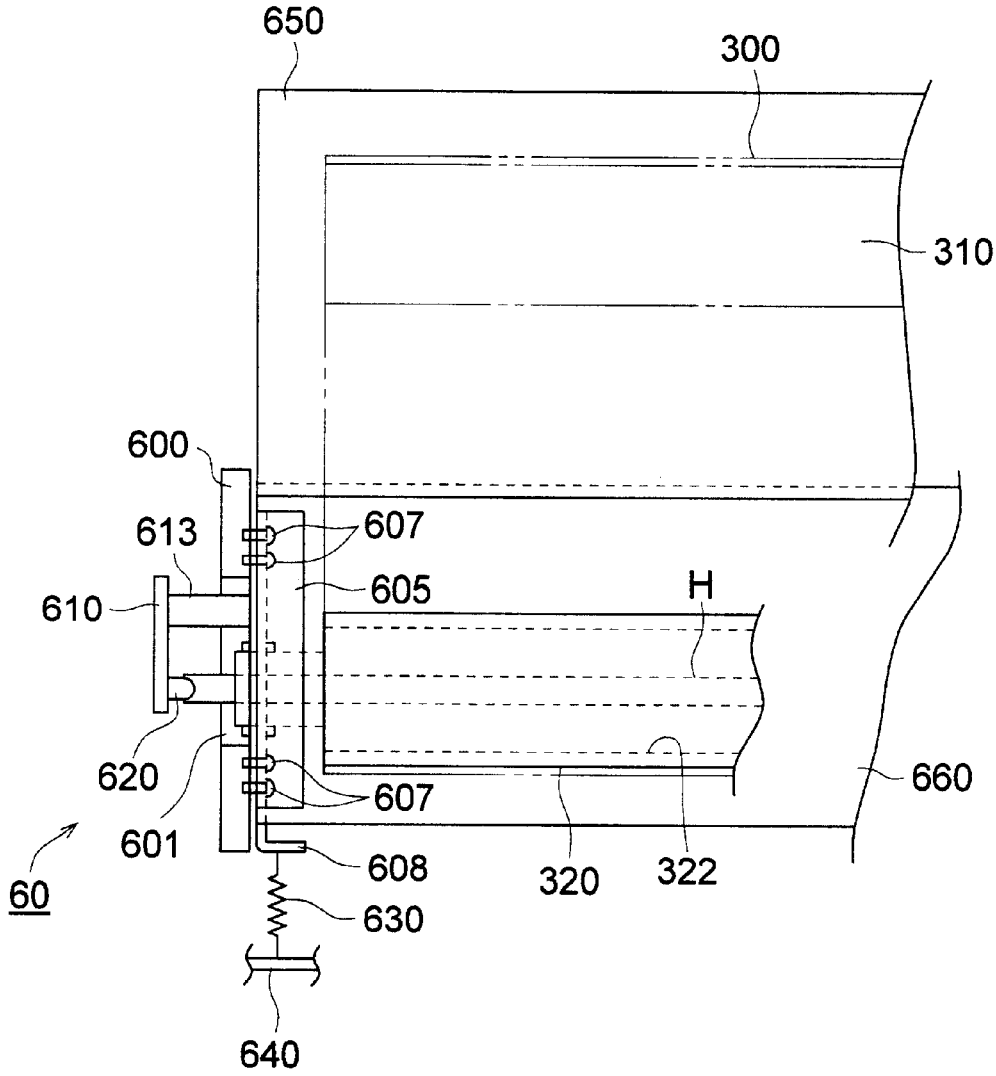
FIG. 4 is a typical plan view showing the structure by which a heat applying source and the second support roller can be integrally moved.

FIG. 4 is a typical plan view showing the structure by which the heat applying source and second support roller can be integrally moved, and in the view, to the same member as the above-described member, the same reference numeral is denoted.

In this connection, because the mechanism relating to the movement has the same structure on the left and right, the right side structure is neglected.

In the view, numeral 60 shows the whole of the movement mechanism, and numeral 605 shows the support member which can move upward and downward, in the view.

The support member 605 is supported by 4 screws 607 studded on a fixed wall 600 of the fixing device through a long hole (not shown) provided in the support member, without any wandering.

Further, the support member 605 has a bent portion 608 as 2 portions in the front and rear directions of the sheet surface (portion from which the leader line 605 is pulled out) and a portion of a leader line shown in the lower side, and on the bent portion in the front and rear directions, a casing 660, which will be described later, is fixed.

Further, onto the support member 605, the second support roller 320 is attached in the position fixed condition through a bushing member such as a bearing.

Numeral 610 is an electric path forming member, and has a function to hold the heat applying source H in the position fixed condition through a contact 620, and fixed in the electric insulation condition onto the support member 605 through a holding member 613.

As described above, the second support roller 320 and heat applying source H are integrally supported on the supporting body 605 keeping the relative position to each other.

In this connection, the electric path forming member 610 can be moved in a U-shaped cutout portion 601 provided in the central portion of the fixed wall 600.

Numeral 630 is a tension providing means composed of a tension spring, and the tension providing means 630 is provided between the bent portion 608 formed on the support member 605 and a fixed member 640 of the fixing device main body.

By the above-described structures, when the force against the tension providing means 630 is applied to the support member 605, the support member 605 is moved in the upward direction in the drawing, in other word, to the direction of the first support roller 310.

Further, the movement of the support member 605 is parallelly moved through the long hole on the support member guided by the screw 607.

Specifically, when the second pressure roller 340 described by using FIG. 1 and the like, is moved from the separation position to a predetermined pressure position, the traveling path of the fixing belt 300 is changed, and the movement force of the fixing belt caused at the changing time is made the drive source, and the urging force against the tension proving means 630 is transmitted from the second support roller 320 to the support member 605, and as a result, the second support roller 320 and heat applying source H are integrally moved.

The above-described structure has a merit in which, for example, when structured such that only the second support roller 320 is moved, the structure is released from a possibility of the interference of the outer periphery of the heat applying source H with the inner wall surface 322 of the second support roller.

Returning again to the description of the drawings, numeral 660 is a casing fixed on the bent portion of the support member 605, and the second support roller is surrounded by a five side wall except the side opposite to the first support roller.

Numeral 650 is a casing having almost the same shape, and the first support roller 310 is surrounded.

In this connection, in the present embodiment, the casing 650 and the casing 660 are structured by plate members, and structured such that, in the opposite portion of both casings, the casing 660 enters the lower side of the casing 650 and moves.

Figure 5:
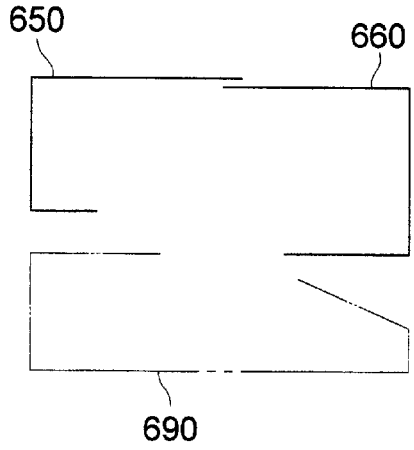
FIG. 5 is a view typically showing the relationship of respective casings.

The relationship of both casings is typically shown in FIG. 5, and the second pressure roller is provided in the lower portion of these casings, and the second pressure roller is formed such that the heat loss is reduced by the other casing 690 formed of the plate material having an appropriate heat insulating material as much as possible.

Figure 6:
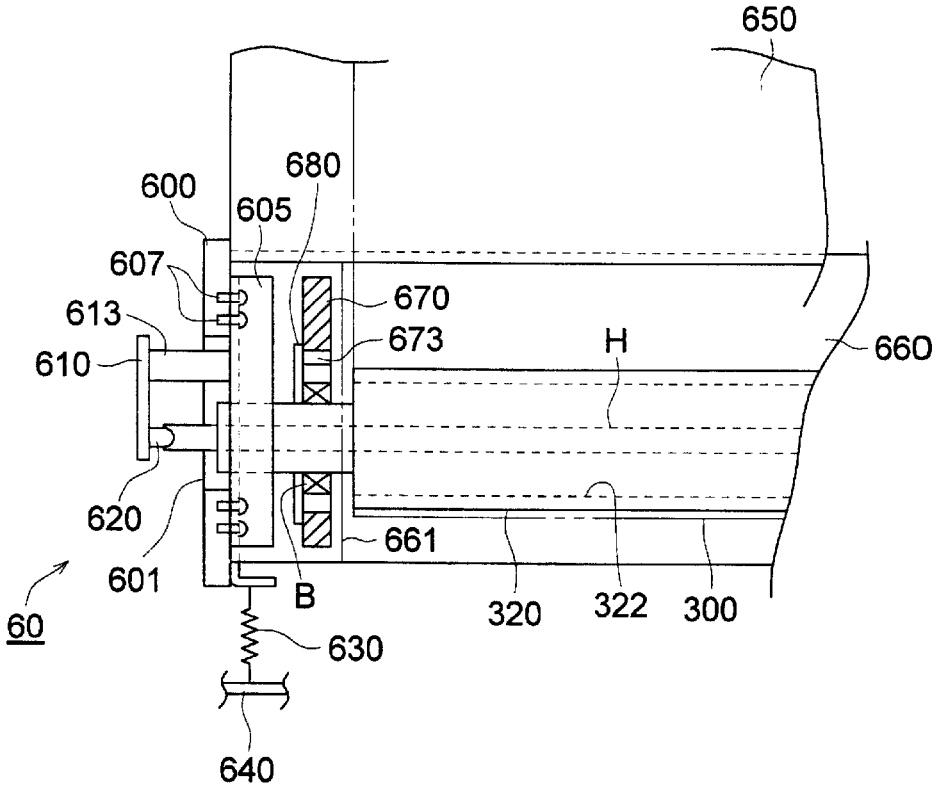
FIG. 6 is a typical plan view showing another embodiment according to the structure of the second support roller and a support member.

FIG. 6 is a typical plan view showing another embodiment according to the structure of the second support roller and the support member.

In also FIG. 6, because the structure of the left and right is the same, only single side one is shown, and the reference numeral in the drawing to the above-described member is denoted by the same reference numeral.

In the present embodiment, the second support roller 320 is supported through a bearing B in the bearing portion provided in the fixed member 670 of the fixing device main body, and the heat applying source H included in the second support roller is supported by the electric path forming member 610 (practically, support member 605) through the same contact 620 as described above.

On the outside of the bearing, a disk-shaped heat resistant material 680 formed of a heat resistant resin is arranged, and the position of the side plate 661 of the casing 660 is between the fixed member 670 and a roller portion (large diameter portion) of the second support roller 320, and the casing itself is fixed on the bent portion of the support member 605 in the same manner as the above-described structure.

Figure 7:
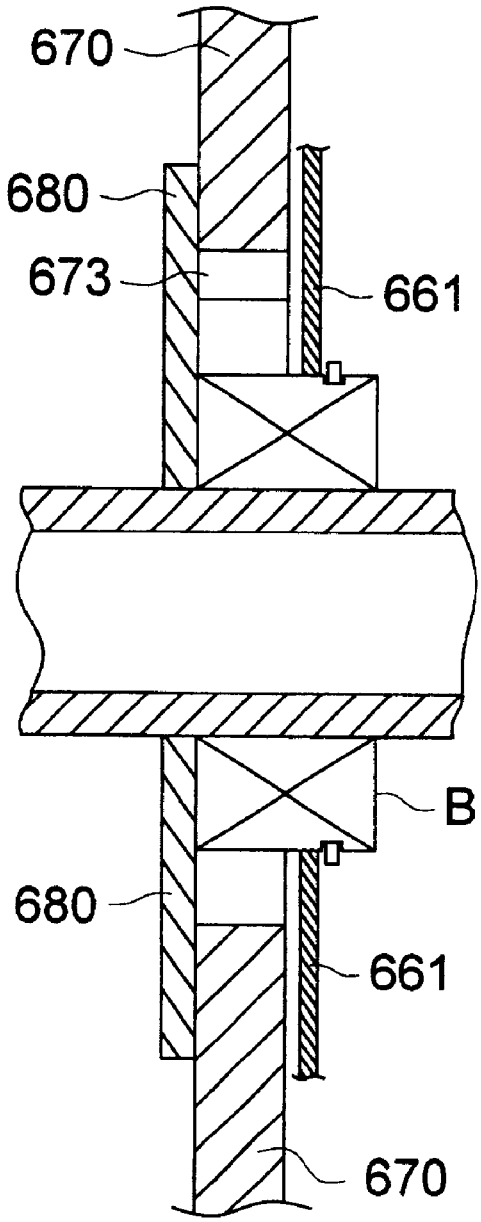
FIG. 7 is an enlarged sectional view in the vicinity of a bearing.

FIG. 7 is an enlarged sectional view of the vicinity of the bearing B, and as shown in the drawing, the bearing B is engaged in a hole provided in the side plate 661, and the casing 660 and side plate 661 are integrated with the bearing B, that is, the second support roller 320, and they do not interfere with each other.

In a case of such the structure, it is necessary that a hole 673 corresponding to the movement amount of the fixing belt is provided in the fixed member, and on the one hand, in order to prevent the heat from flowing from the hole 673, the diameter of the outside of the heat resistant member 680 is increased, thereby, the gap is choked up.

In this connection, in the embodiment in FIG. 4 and FIG. 6, the structure is made in such a manner that, with the second support roller housing the heat applying source whose position is moved accompanied by the change of the traveling path of the fixing belt, the whole casing appropriately surrounding the second support roller can be integrally moved, however, this structure is not always necessary, and for example, it can also be structured such that only a portion corresponding to the side plate of the casing can be integrally moved.

In the fixing device in which the support roller housing the heat applying source is positionally moved, the interference at the movement time of both can be securely prevented, and because the contact area for the fixing onto the sheet can be increased, thereby, the stable fixing processing can be conducted.

Together with the positional movement of the support roller housing the heat applying source, the casing surrounding the support roller is integrally moved, thereby, the volume in the fixing device can be reduced, and because it can be easily reduced that the heat flows out to the outside of the fixing device, the heat energy can be effectively utilized.

What is claimed is:

1. A fixing apparatus comprising:

(a) a plurality of supporting rollers including a rotary supporting roller housing therein a heat applying source;

(b) a fixing belt trained about the plurality of supporting rollers;

(c) a pressure applying roller positioned selectably in a pressure applying position to press the fixing belt thereby to change a traveling path of the fixing belt; and (d) a supporting member for movably and integrally supporting the rotary supporting roller and a casing for heat-shielding the rotary supporting roller from a periphery thereof, the supporting member being moved by the fixing belt subjected to the change of the traveling path thereof.

2. An image fixing apparatus comprising:

(a) a plurality of supporting rollers including a single supporting roller housing therein a heat applying source;

(b) a fixing belt trained about the plurality of supporting rollers; and (c) a paired pressure applying rollers which are arranged to face each other in spaced relation with respect to the fixing belt, wherein a relative position of the paired pressure applying rollers is changed to a pressure position thereby a traveling path of the fixing belt is changed and further positions of the heat applying source and the single supporting roller housing therein the heat applying source are integrally movable through the fixing belt in which the traveling path has been changed.

3. The image fixing apparatus of claim 2, wherein one of the paired pressure applying roller is the supporting roller other than the single supporting roller housing therein the heat applying source.

4. The image fixing apparatus of claim 2, wherein the heat applying roller supports the single supporting roller housing therein the heat applying source and is stationarily supported on a supporting member movably provided on a mounting portion of a fixing apparatus main body.

5. The image fixing apparatus of claim 3, wherein a change of the traveling path of the fixing belt is conducted by a positional movement of the pressure applying roller disposed outside the fixing belt.

6. An image forming apparatus comprising:

(a) the image fixing apparatus set forth in claim 1;

(b) a controller for controlling movement to the pressing position of the pressure applying roller against the fixing belt along with a fixing processing operation, and release of the pressure of the pressure applying roller.

7. An image forming apparatus comprising:

(a) the image fixing apparatus set forth in claim 2;

(b) a controller for controlling movement to the pressing position of the pressure applying roller against the fixing belt along with a fixing processing operation, and release of the pressure of the pressure applying roller.

* * * * *